US008998596B2

(12) United States Patent
Nagahara et al.

(10) Patent No.: US 8,998,596 B2
(45) Date of Patent: Apr. 7, 2015

(54) SCROLL COMPRESSOR

(75) Inventors: Kenji Nagahara, Osaka (JP); Youhei Nishide, Osaka (JP); Nobuhiro Nojima, Osaka (JP); Yoshinobu Yosuke, Osaka (JP); Takashi Uekawa, Osaka (JP); Masanori Masuda, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 13/393,720

(22) PCT Filed: Sep. 2, 2010

(86) PCT No.: PCT/JP2010/005421
§ 371 (c)(1),
(2), (4) Date: Mar. 1, 2012

(87) PCT Pub. No.: WO2011/027567
PCT Pub. Date: Mar. 10, 2011

(65) Prior Publication Data

US 2012/0164014 A1 Jun. 28, 2012

(30) Foreign Application Priority Data

Sep. 2, 2009 (JP) ..... 2009-202448

(51) Int. Cl.
*F01C 1/02* (2006.01)
*F04C 2/02* (2006.01)
(Continued)

(52) U.S. Cl.
CPC ..... *F04C 18/0261* (2013.01); *F04C 18/0215* (2013.01); *F04C 23/008* (2013.01); *F04C 27/005* (2013.01)

(58) Field of Classification Search
CPC .. F04C 23/008; F04C 18/0215; F04C 27/005; F04C 28/16; F04C 18/0261
USPC ..... 418/55.4, 55.5, 59, 15, 55.1, 57
See application file for complete search history.

(56) References Cited

U.S. PATENT DOCUMENTS 4,596,521 A * 6/1986 Murayama et al. ..... 418/55.1
6,273,691 B1 * 8/2001 Morimoto et al. ..... 418/15
(Continued)

FOREIGN PATENT DOCUMENTS

CN 1102205 C 2/2003
JP 58-122386 A 7/1983
(Continued)

OTHER PUBLICATIONS

International Search Report of corresponding PCT Application No. PCT/JP2010/005421 mailed on Sep. 28, 2010.

*Primary Examiner* — Mary A Davis
*Assistant Examiner* — Daniel Wagnitz
(74) *Attorney, Agent, or Firm* — Global IP Counselors

(57) ABSTRACT

A scroll compressor includes a pressing mechanism and a back-flow prevention mechanism. The pressing mechanism includes a back-pressure chamber facing a back surface of a movable-scroll end plate, and a back-pressure supply path arranged to allow the back-pressure chamber to communicate with a compression chamber which is in a state right before the compression chamber communicates with an outlet port or a state in which the compression chamber communicates with the outlet port. The back-flow prevention mechanism allows refrigerant of the back-pressure supply path to flow from the compression chamber to the back-pressure chamber, and prevents fluid of the back-pressure supply path from returning from the back-pressure chamber to the compression chamber.

16 Claims, 9 Drawing Sheets

(51) Int. Cl.

| | |
|---|---|
| ***F04C 18/02*** | (2006.01) |
| ***F04C 27/00*** | (2006.01) |
| *F04C 23/00* | (2006.01) |

(56) References Cited

U.S. PATENT DOCUMENTS

| | | | | |
|---|---|---|---|---|
| 7,338,265 | B2 * | 3/2008 | Grassbaugh et al. | 418/55.4 |
| 2003/0190247 | A1 | 10/2003 | Tsubono et al. | |
| 2004/0191083 | A1 * | 9/2004 | Gennami et al. | 417/310 |
| 2004/0247476 | A1 | 12/2004 | Tsubono et al. | |
| 2006/0051226 | A1 | 3/2006 | Tsubono et al. | |
| 2006/0057010 | A1 | 3/2006 | Tsubono et al. | |
| 2006/0127263 | A1 * | 6/2006 | Hwang et al. | 418/59 |

FOREIGN PATENT DOCUMENTS

| | | | |
|---|---|---|---|
| JP | 6-50274 | A | 2/1994 |
| JP | 8-26861 | B2 | 3/1996 |
| JP | 8-319960 | A | 12/1996 |
| JP | 4156494 | B2 | 7/2008 |

* cited by examiner (A)

(B)

SCROLL COMPRESSOR

CROSS-REFERENCE TO RELATED APPLICATIONS

This U.S. National stage application claims priority under 35U.S.C. §119(a) to Japanese Patent Application No. 2009-202448, filed in Japan on Sep. 2, 2009, the entire contents of which are hereby incorporated herein by reference.

TECHNICAL FIELD

The present invention relates to a scroll compressor including a mechanism for pressing a movable scroll against a fixed scroll.

BACKGROUND ART

Conventionally, a scroll compressor has been known as a compressor for compressing fluid. In the scroll compressor, a fixed scroll and a movable scroll are engaged with each other, thereby forming a compression chamber between the fixed scroll and the movable scroll. As the compression chamber moves from the periphery toward the center in association with eccentric rotation of the movable scroll, the volume of the compression chamber is gradually decreased. Fluid is compressed in the course of decreasing the volume of the compression chamber.

In the scroll compressor, the pressure of fluid of the compression chamber acts on the movable scroll as separating force for separating the movable scroll from the fixed scroll. Thus, it is necessary that pressing force for pressing the movable scroll against the fixed scroll is provided to the movable scroll. Japanese Patent Publication No. S58-122386discloses a scroll compressor including a mechanism for pressing a movable scroll against a fixed scroll. In the scroll compressor, back-pressure holes are formed in an end plate of the movable scroll, and a back-pressure chamber is formed so as to face a back surface of the end plate of the movable scroll. The back-pressure holes open to a compression chamber which is in the course of compressing fluid. Intermediate-pressure fluid is introduced into the back-pressure chamber.

SUMMARY

Technical Problem

In a scroll compressor, a ratio of the volume (suction volume) of a compression chamber at the time of entering a state in which the compression chamber communicates with an outlet port, to the volume (displacement volume) of the compression chamber at the time of isolating the compression chamber from an inlet port is constant.

Thus, in the scroll compressor, under an operation condition of high differential pressure, i.e., under a condition where the difference between the pressure of fluid at an inlet and the pressure (hereinafter referred to as "discharge pressure") of fluid at an outlet is large, insufficient compression in which the internal pressure of the compression chamber right before the compression chamber communicates with the outlet port is lower than the discharge pressure is caused. Due to the insufficient compression, after the compression chamber communicates with the outlet port, fluid flows back to the compression chamber from outside through the outlet port. Then, the internal pressure of the compression chamber is rapidly increased and reaches the discharge pressure.

For the foregoing reason, in the conventional scroll compressor in which fluid is introduced into the back-pressure chamber from the compression chamber which is in the course of compressing fluid, if the insufficient compression is caused, the difference between a peak value of the internal pressure of the compression chamber and the internal pressure of the compression chamber communicating with the back-pressure chamber is increased. Thus, since the difference between the peak value of the internal pressure of the compression chamber acting as the separating force and the internal pressure of the back-pressure chamber acting as the pressing force is increased, there is a possibility that the pressing force is lacked against the separating force.

In order to avoid the lack of the pressing force when the insufficient compression is caused, fluid having the discharge pressure may be introduced into the back-pressure chamber. If the insufficient compression is caused, the discharge pressure is equal to the peak value of the internal pressure of the compression chamber. Thus, the fluid having the discharge pressure is introduced into the back-pressure chamber, thereby avoiding the lack of the pressing force against the separating force.

However, under an operation condition of low differential pressure, i.e., under a condition where the difference between the pressure of fluid at the inlet and the pressure of fluid at the outlet is small, over-compression in which the internal pressure of the compression chamber right before the compression chamber communicates with the outlet port is higher than the discharge pressure is caused in the scroll compressor. If the over-compression is caused, the internal pressure of the compression chamber is rapidly decreased after the compression chamber communicates with the outlet port, and then reaches the discharge pressure.

For the foregoing reason, when fluid having the discharge pressure is introduced into the back-pressure chamber, if the over-compression is caused, the internal pressure of the compression chamber acting as the separating force right before the compression chamber communicates with the outlet port is higher than the internal pressure of the back-pressure chamber acting as the pressing force, and therefore there is a possibility that the pressing force is lacked against the separating force.

As described above, under any one of the operation condition of high differential pressure or the operation condition of low differential pressure, there is a possibility that the pressing force is lacked against the separating force. If the pressing force is lacked, the movable scroll is inclined, and fluid leaks from the compression chamber. As a result, compression efficiency is degraded.

The present invention has been made in view of the foregoing, and it is an objective of the present invention to, in a scroll compressor including a pressing mechanism for pressing a movable scroll against a fixed scroll, avoid lack of pressing force against separating force under any operation conditions.

Solution to the Problem

A first aspect of the invention is directed to a scroll compressor which includes a fixed scroll (60) having an outlet port (64), and a movable scroll (70) engaged with the fixed scroll (60) and forming a compression chamber (23) together with the fixed scroll (60), and which compresses fluid of the compression chamber (23) by driving the movable scroll (70). The scroll compressor of the first aspect of the invention includes a pressing mechanism (75) including a back-pressure chamber (53) facing a back surface of a movable-scroll end plate (71) of the movable scroll (70) and a back-pressure supply path (80) for allowing the back-pressure chamber (53) to communicate with the compression chamber (23) which is in a state right before the compression chamber (23) communicates with the outlet port (64) and a state in which the compression chamber (23) communicates with the outlet port (64), and configured to press the movable scroll (70) against the fixed scroll (60) by internal pressure of the back-pressure chamber (53); and a back-flow prevention mechanism (35) configured to allow fluid of the back-pressure supply path (80) to flow from the compression chamber (23) to the back-pressure chamber (53) and prevent fluid of the back-pressure supply path (80) from returning from the back-pressure chamber (53) to the compression chamber (23).

In the first aspect of the invention, the back-pressure supply path (80) of the pressing mechanism (75) communicates with the compression chamber (23) which is in the state right before the compression chamber (23) communicates with the outlet port (64) or state in which the compression chamber (23) communicates with the outlet port (64). Thus, in association with rotation of the movable scroll (70), the scroll compressor alternately enters the state in which the back-pressure supply path (80) communicates with the compression chamber (23) right before the compression chamber (23) communicates with the outlet port (64) and the state in which the back-pressure supply path (80) communicates with the compression chamber (23) communicating with the outlet port (64).

When over-compression is caused under an operation condition of low differential pressure, the internal pressure of the compression chamber (23) right before the compression chamber (23) communicates with the outlet port (64) is higher than discharge pressure, and the internal pressure of the compression chamber (23) communicating with the outlet port (64) is equal to the discharge pressure. That is, the internal pressure of the compression chamber (23) right before the compression chamber (23) communicates with the outlet port (64) is higher than the internal pressure of the compression chamber (23) communicating with the outlet port (64). The back-pressure supply path (80) communicates alternately with the compression chamber (23) having high internal pressure and the compression chamber (23) having low internal pressure, in association with the rotation of the movable scroll (70).

On the other hand, when insufficient compression is caused under an operation condition of high differential pressure, the internal pressure of the compression chamber (23) right before the compression chamber (23) communicates with the outlet port (64) is lower than the discharge pressure, and the internal pressure of the compression chamber (23) communicating with the outlet port (64) is equal to the discharge pressure. That is, the internal pressure of the compression chamber (23) communicating with the outlet port (64) is higher than the internal pressure of the compression chamber (23) right before the compression chamber (23) communicates with the outlet port (64). As in the case where the over-compression is caused, the back-pressure supply path (80) communicates alternately with the compression chamber (23) having high internal pressure and the compression chamber (23) having low internal pressure.

In the back-pressure supply path (80), the back-flow prevention mechanism (35) prevents fluid from returning from the back-pressure chamber (53) to the compression chamber (23). Thus, when the back-pressure supply path (80) communicates with the compression chamber (23) having high internal pressure, fluid is introduced into the back-pressure chamber (53) from the compression chamber (23). On the other hand, when the back-pressure supply path (80) communicates with the compression chamber (23) having low internal pressure, the back-flow prevention mechanism (35) prevents fluid of the back-pressure chamber (53) from returning to the compression chamber (23). When the back-pressure supply path (80) communicates with the compression chamber (23) having low internal pressure, the internal pressure of the back-pressure chamber (53) is not decreased due to returning of fluid of the back-pressure chamber (53) to the compression chamber 23). The internal pressure of the back-pressure chamber (53) is adjusted so as to approach the high internal pressure of the compression chamber (23).

Thus, when the over-compression is caused, the internal pressure of the back-pressure chamber (53) is adjusted so as to approach the internal pressure of the compression chamber (23) right before the compression chamber (23) communicates with the outlet port (64). On the other hand, when the insufficient compression is caused, the internal pressure of the back-pressure chamber (53) is adjusted so as to approach the internal pressure of the compression chamber (23) communicating with the outlet port (64). In the first aspect of the invention, even if any of the over-compression and the insufficient compression are caused, the internal pressure of the back-pressure chamber (53) is adjusted so as to approach the maximum pressure in a pressure change of fluid in the compression chamber (23). The internal pressure of the back-pressure chamber (53) is finally maintained at the pressure close to or equal to the maximum pressure in the pressure change of fluid in the compression chamber (23).

Note that the phrase "right before the compression chamber (23) communicates with the outlet port (64)" indicates a time period right before the outlet port (64) communicates with the compression chamber (23) in a single compression phase performed after confinement of fluid within the compression chamber (23) is completed and before the outlet port (64) communicates with the compression chamber (23), and means the end of the compression phase. The "compression chamber (23) right before the compression chamber (23) communicates with the outlet port (64)" is in an over-compression state when the over-compression is caused.

A second aspect of the invention is directed to the scroll compressor of the first aspect of the invention, in which an inlet space (24) communicating with the compression chamber (23) which is in a fluid suction phase is formed in a casing (10) in which the fixed scroll (60) and the movable scroll (70) are accommodated, and a back-pressure reduction mechanism (26) for allowing the back-pressure chamber (53) to communicate with the inlet space (24) when a difference between the internal pressure of the back-pressure chamber (53) and the internal pressure of the inlet space (24) is equal to or higher than a predetermined differential pressure reference value is provided.

In the second aspect of the invention, the back-pressure reduction mechanism (26) allows fluid to flow from the back-pressure chamber (53) to the inlet space (24) when the internal pressure of the back-pressure chamber (53) is higher than the pressure of the inlet space (24) by the value equal to or higher than the predetermined differential pressure reference value. That is, when the internal pressure of the back-pressure chamber (53) is higher than the pressure of the inlet space (24) by the value equal to or higher than the predetermined differential pressure reference value, the back-pressure reduction mechanism (26) reduces the internal pressure of the back-pressure chamber (53).

A third aspect of the invention is directed to the scroll compressor of the first or second aspect of the invention, in which a relief port (67) for releasing fluid which is being compressed from the compression chamber (23) communicating with the back-pressure supply path (80) right before the compression chamber (23) communicates with the outlet port (64) is formed in the fixed scroll (60) so as to communicate with the compression chamber (23) after the back-pressure supply path (80) communicates with the compression chamber (23).

In the third aspect of the invention, the relief port (67) is provided for the compression chamber (23) (hereinafter referred to as a "target compression chamber (23)") communicating with the back-pressure supply path (80) right before the compression chamber (23) communicates with the outlet port (64). When the over-compression is caused in the target compression chamber (23), the relief port (67) allows fluid to flow from the target compression chamber (23), thereby reducing the internal pressure of the target compression chamber (23). After the target compression chamber (23) communicates with the back-pressure supply path (80), the target compression chamber (23) communicates with the relief port (67). Thus, fluid is introduced into the back-pressure chamber (53) from the target compression chamber (23) before the pressure of the target compression chamber (23) is reduced by the relief port (67).

A fourth aspect of the invention is directed to the scroll compressor of any one of the first to third aspects of the invention, in which the compression chamber (23) includes a first compression chamber (23*a*) formed between an inner surface of a fixed-scroll wrap (62) of the fixed scroll (60) and an outer surface of a movable-scroll wrap (72) of the movable scroll (70), and a second compression chamber (23*b*) formed between an outer surface of the fixed-scroll wrap (62) and an inner surface of the movable-scroll wrap (72), the movable scroll (70) and the fixed scroll (60) are configured such that a compression ratio of the first compression chamber (23*a*) and a compression ratio of the second compression chamber (23*b*) are different from each other, and the back-pressure supply path (80) communicates only with the first compression chamber (23*a*) having the higher compression ratio than that of the second compression chamber (23*b*) right before the outlet port (64) communicates with the first compression chamber (23*a*).

In the fourth aspect of the invention, the movable scroll (70) and the fixed scroll (60) are configured such that the compression ratio of the first compression chamber (23*a*) and the compression ratio of the second compression chamber (23*b*) are different from each other by, e.g., a length difference between the movable-scroll wrap (72) and the fixed-scroll wrap (62). The back-pressure supply path (80) communicates only with the compression chamber (23*a*) having the higher compression ratio than that of the second compression chamber (23*b*) right before the outlet port (64) communicates with the compression chamber (23*a*). Thus, when the over-compression is caused, the internal pressure of the back-pressure chamber (53) is adjusted to the higher one of the maximum pressure of the first compression chamber (23*a*) or the maximum pressure of the second compression chamber (23*b*).

A fifth aspect of the invention is directed to the scroll compressor of any one of the first to third aspects of the invention, in which the compression chamber (23) includes a first compression chamber (23*a*) formed between an inner surface of a fixed-scroll wrap (62) of the fixed scroll (60) and an outer surface of a movable-scroll wrap (72) of the movable scroll (70), and a second compression chamber (23*b*) formed between an outer surface of the fixed-scroll wrap (62) and an inner surface of the movable-scroll wrap (72), and the back-pressure supply path (80) includes a first inlet (91) communicating with the first compression chamber (23*a*) right before the first compression chamber (23*a*) communicates with the outlet port (64), and a second inlet (92) communicating with the second compression chamber (23*b*) right before the second compression chamber (23*b*) communicates with the outlet port (64).

In the fifth aspect of the invention, the back-pressure supply path (80) includes the first inlet (91) and the second inlet (92). The first inlet (91) communicates with the first compression chamber (23*a*) right before the first compression chamber (23*a*) communicates with the outlet port (64). The second inlet (92) communicates with the second compression chamber (23*b*) right before the second compression chamber (23*b*) communicates with the outlet port (64). Thus, the back-pressure chamber (53) communicates with both of the first compression chamber (23*a*) right before the first compression chamber (23*a*) communicates with the outlet port (64) and the second compression chamber (23*b*) right before the second compression chamber (23*b*) communicates with the outlet port (64).

A sixth aspect of the invention is directed to the scroll compressor of any one of the first to fifth aspects of the invention, which further includes a drive shaft (40) including a main shaft section (41) and an eccentric section (42) engaged with the movable scroll (70) so as to be eccentric to the main shaft section (41). The back-pressure supply path (80) is formed in the movable scroll (70). The back-flow prevention mechanism (35) includes a valve member (36) moving in a predetermined first direction when the back-flow prevention mechanism (35) is switched from a state in which fluid circulation in the back-pressure supply path (80) is prevented to a state in which the fluid circulation in the back-pressure supply path (80) is allowed. When the outlet port (64) comes to communicate with the compression chamber (23) communicating with the back-pressure supply path (80), an angle between the first direction and a second direction which is a direction of a line from a shaft center of the main shaft section (41) toward a shaft center of the eccentric section (42) is equal to or greater than −90° and equal to or less than 90° as viewed in an axial direction of the drive shaft (40), supposing that a rotation direction of the drive shaft (40) is a positive direction.

In the sixth aspect of the invention, when the state in which the target compression chamber (23) communicating with the back-pressure supply path (80) does not communicate with the outlet port (64) enters the state in which the target compression chamber (23) communicating with the back-pressure supply path (80) communicates with the outlet port (64), i.e., when the over-compression is caused and then the internal pressure of the target compression chamber (23) reaches the maximum pressure, the angle between the first and second directions is equal to or greater than −90° and equal to or less than 90°, supposing that the rotation direction of the drive shaft (40) is the positive direction. Thus, at the foregoing point of time, the magnitude of a first-direction component of centrifugal force acting on the valve member (36) is equal to or greater than zero.

A seventh aspect of the invention is directed to the scroll compressor of the sixth aspect of the invention, in which the angle between the first and second directions is equal to or greater than 0° and equal to or less than 90°, supposing that the rotation direction of the drive shaft (40) is the positive direction.

In the seventh aspect of the invention, when the over-compression is caused and then the internal pressure of the target compression chamber (23) reaches the maximum pressure, the angle between the first and second directions is equal to or greater than 0° and equal to or less than 90°, supposing that the rotation direction of the drive shaft (40) is the positive direction. The magnitude of the first-direction component of centrifugal force acting on the valve member (36) is maximum when the angle between the first and second directions is 0°. In the seventh aspect of the invention, the magnitude of the first-direction component of centrifugal force acting on the valve member (36) is maximum before the foregoing point of time.

Advantages of the Invention

In the present invention, even if any of the over-compression and the insufficient compression are caused, the back-pressure supply path (80) communicates with the compression chamber (23) having the maximum pressure in the pressure change of fluid, and the back-flow prevention mechanism (35) prevents the decrease in internal pressure of the back-pressure chamber (53). Thus, the internal pressure of the back-pressure chamber (53) is maintained at the pressure close to or equal to the maximum pressure in the pressure change of fluid in the compression chamber (23). The maximum pressure in the pressure change of fluid results in the maximum separating force. In the present invention, in any of the foregoing cases, the internal pressure of the backpressure chamber (53) is adjusted to the pressure when the separating force is maximum. Thus, lack of pressing force against the separating force can be avoided under any operation conditions. In addition, degradation of compression efficiency which is caused as follows can be avoided: the movable scroll (70) is inclined due to the lack of the pressing force and fluid leaks from the compression chamber (23) due to the inclination of the movable scroll (70).

In the second aspect of the invention, when the internal pressure of the back-pressure chamber (53) is higher than the pressure of the inlet space (24) by the value equal to or higher than the predetermined differential pressure reference value, the back-pressure reduction mechanism (26) reduces the internal pressure of the back-pressure chamber (53). As described above, even if any of the over-compression and the insufficient compression are caused, the internal pressure of the back-pressure chamber (53) is maintained at the pressure close to or equal to the maximum pressure in the pressure change of fluid in the compression chamber (23). That is, when comparing the case where the over-compression is caused and the case where the insufficient compression is caused, there is little difference between the internal pressure of the backpressure chamber (53) and the maximum internal pressure of the compression chamber (23). However, in the case where the insufficient compression is caused, the maximum pressure of the compression chamber (23) is higher than that right before the outlet port (64) communicates with the compression chamber (23) due to a back-flow of fluid caused after the outlet port (64) communicates with the compression chamber (23). Thus, if the backpressure reduction mechanism (26) is not provided, the difference between the internal pressure of the back-pressure chamber (53) and the internal pressure of the compression chamber (23) which is in the fluid suction phase is increased as compared to the case where the over-compression is caused. As a result, since the difference between the pressing force and the separating force is larger in the case where the insufficient compression is caused than the case where the over-compression is caused, there is a possibility that excessive thrust loss is caused in the case where the insufficient compression is caused.

In view of the foregoing, in the second aspect of the invention, when the internal pressure of the back-pressure chamber (53) is higher than the pressure of the inlet space (24) by the value equal to or greater than the predetermined differential pressure reference value, the back-pressure reduction mechanism (26) reduces the internal pressure of the back-pressure chamber (53). Thus, when the insufficient compression is caused, the difference between the internal pressure of the back-pressure chamber (53) and the internal pressure of the compression chamber (23) which is in the fluid suction phase can be decreased. Consequently, when the insufficient compression is caused, the excessive thrust loss can be reduced.

In the third aspect of the invention, since the relief port (67) communicates with the target compression chamber (23) after the back-pressure supply path (80) communicates with the target compression chamber (23), fluid is introduced into the back-pressure chamber (53) from the target compression chamber (23) before the pressure of the target compression chamber (23) is reduced by the relief port (67). Thus, when the over-compression is caused, high-pressure fluid is introduced into the back-pressure chamber (53), thereby ensuring the pressing force and reducing the degree of over-compression.

In the fourth aspect of the invention, when the over-compression is caused, the internal pressure of the back-pressure chamber (53) is adjusted to the higher one of the maximum pressure of the first compression chamber (23*a*) or the maximum pressure of the second compression chamber (23*b*). Thus, the great pressing force can be obtained, and therefore it can be ensured that the lack of the pressing force against the separating force is avoided.

In the fifth aspect of the invention, the back-pressure chamber (53) communicates with both of the first compression chamber (23*a*) right before the first compression chamber (23*a*) communicates with the outlet port (64) and the second compression chamber (23*b*) right before the second compression chamber (23*b*) communicates with the outlet port (64). A time for which the back-pressure chamber (53) communicates with the compression chamber (23) right before the compression chamber (23) communicates with the outlet port (64) is longer than a time for which the back-pressure chamber (53) communicates only with one of the first compression chamber (23*a*) or the second compression chamber (23*b*). Thus, when the over-compression is caused, fluid of the compression chamber (23) right before the compression chamber (23) communicates with the outlet port (64) is easily introduced into the back-pressure chamber (53), and therefore it can be ensured that the internal pressure of the back-pressure chamber (53) is stably increased.

In the sixth aspect of the invention, when the over-compression is caused and then the internal pressure of the target compression chamber (23) reaches the maximum pressure, the magnitude of the first-direction component of centrifugal force acting on the valve member (36) is equal to or greater than zero. When the magnitude of the first-direction component of centrifugal force acting on the valve member (36) at the foregoing point of time is represented by a negative value, the valve member (36) does not move to a position where the fluid circulation is allowed as long as the difference between force acting on the valve member (36) from a side closer to the compression chamber (23) and force acting on the valve member (36) from a side closer to the back-pressure chamber (53) is not larger than the magnitude of a component in a direction opposite to the first direction of centrifugal force. Thus, at the foregoing point of time, if the difference between the force acting on the valve member (36) from the side closer to the compression chamber (23) and the force acting on the valve member (36) from the side closer to the back-pressure chamber (53) is small, fluid of the target compression chamber (23) is not introduced into the back-pressure chamber (53). On the other hand, in the sixth aspect of the invention, The magnitude of the first-direction component of centrifugal force acting on the valve member (36) is equal to or greater than zero at the foregoing point of time. Thus, even if the difference between the force acting on the valve member (36) from the side closer to the compression chamber (23) and the force acting on the valve member (36) from the side closer to the back-pressure chamber (53) is small, the valve member (36) moves to the position where the fluid circulation is allowed. Consequently, the internal pressure of the back-pressure chamber (53) can be increased to higher pressure.

In the seventh aspect of the invention, the magnitude of the first-direction component of centrifugal force acting on the valve member (36) is maximum before the internal pressure of the target compression chamber (23) reaches the maximum pressure. If the magnitude of the first-direction component of centrifugal force acting on the valve member (36) is maximum after the foregoing point of time, there is a possibility that the valve member (36) is not quickly returned to a position where the fluid circulation is prevented after the foregoing point of time. Thus, when the over-compression is caused, there is a possibility that a time for which the back-pressure chamber (53) communicates with the target compression chamber (23) having the pressure reduced by communicating with the outlet port (64) is increased, resulting in a decrease in pressure of the back-pressure chamber (53). On the other hand, in the seventh aspect of the invention, the magnitude of the first-direction component of centrifugal force acting on the valve member (36) is maximum before the foregoing point of time. Thus, the valve member (36) is easily and quickly returned to the position where the fluid circulation is prevented. Consequently, the increase in time for which the back-pressure chamber (53) communicates with the target compression chamber (23) having the pressure reduced by communicating with the outlet port (64) can be avoided when the over-compression is caused, thereby reducing the decrease in pressure of the back-pressure chamber (53).

BRIEF DESCRIPTION OF THE DRAWINGS

FIG. 5(A) is the cross-sectional view when an angle between first and second directions is 0°. FIG. 5(B) is the cross-sectional view when the angle between the first and second directions is a value close to 90.

DESCRIPTION OF EMBODIMENTS

An embodiment of the present invention will be described below in detail with reference to drawings.

The embodiment of the present invention will be described. The present embodiment is directed to a scroll compressor (1) of the present invention. The scroll compressor (1) of the present embodiment is connected to, e.g., a refrigerant circuit of an air conditioning apparatus for performing cooling and heating operations, and increases the pressure of low-pressure refrigerant evaporated in an evaporator to high pressure in a refrigeration cycle. In the air conditioning apparatus, differential pressure which is the difference between the high pressure in the refrigeration cycle and low pressure in the refrigeration cycle is changed depending on the temperature of outdoor air exchanging heat with refrigerant in an outdoor heat exchanger. In association with such a change, the difference between the pressure of refrigerant to be sucked and the pressure of refrigerant to be discharged is changed in the scroll compressor (1).

Figure 1:
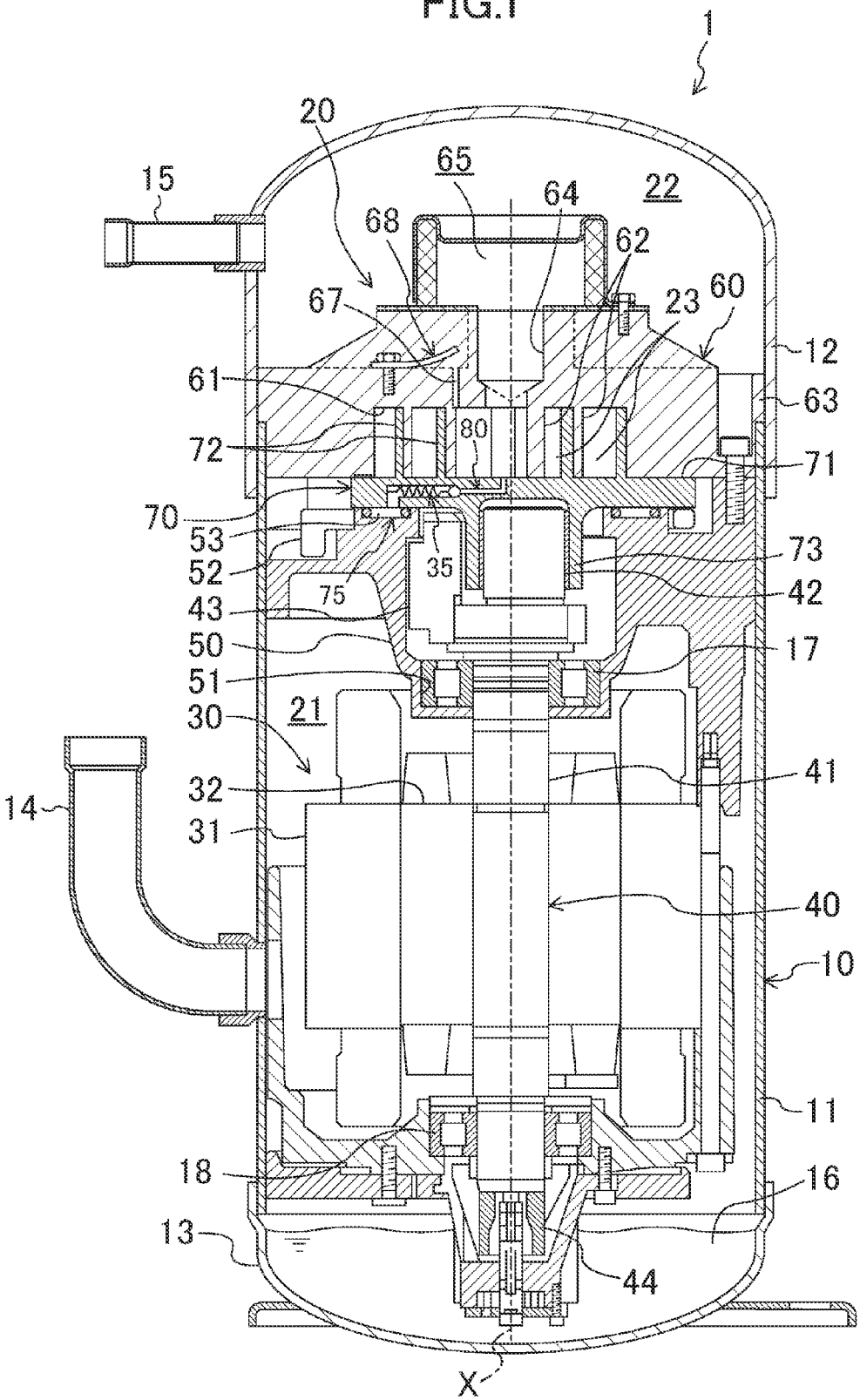
FIG. 1 is a longitudinal sectional view of a scroll compressor of an embodiment.

As illustrated in FIG. 1, the scroll compressor (1) of the present embodiment includes an elongated casing (10) which is a hermetic container. In the casing (10), an electric motor (30) and a compression mechanism (20) are arranged in this order from bottom to top. In addition, in the casing (10), a vertically-extending drive shaft (40) is provided.

The casing (10) includes a body (11) formed in an elongated cylindrical shape, an upper end plate (12) welded to an upper end of the body (11) so as to hermetically seal the casing (10), and a lower end plate (13) welded to a lower end of the body (11) so as to hermetically seal the casing (10). A housing (50) dividing an inner space of the casing (10) into upper and lower spaces is press-fitted into the body (11) of the casing (10) and is fixed to the body (11) of the casing (10).

In addition, in the casing (10), an inlet pipe (14) penetrating the body (11) and an outlet pipe (15) penetrating the upper end plate (12) are provided. A lower end portion in the inner space of the casing (10) serves as a low-pressure oil storage section (16) for storing lubricant oil. Suction pressure which is the pressure of refrigerant sucked into the casing (10) acts on the lubricant oil stored in the low-pressure oil storage section (16).

The housing (50) is in substantially a discoid shape. A center portion of the housing (50) is recessed, and a through-hole (51) is formed at the center of the recess. An upper bearing section (17) for rotatably supporting the drive shaft (40) is provided in the through-hole (51). In addition, in the lower space of the casing (10), a lower bearing section (18) for rotatably supporting the drive shaft (40) is provided.

The electric motor (30) is a so-called "brushless DC motor," and is arranged below the housing (50). The electric motor (30) includes a stator (31) and a rotor (32). The stator (31) includes a stator core and a coil attached to the stator core, and is formed in substantially a cylindrical shape. The stator (31) is fixed to the body (11) of the casing (10). The stator (31) is electrically connected to power supply terminals (not shown in the figure) attached to the body (11). On the other hand, the rotor includes a rotor core and a permanent magnet embedded in the rotor core. The rotor (32) is connected to a main shaft section (41) of the drive shaft (40), and is arranged inside the stator (31). When the electric motor (30) is actuated, the rotor (32) rotates, and then the drive shaft (40) also rotates in association with the rotation of the rotor (32).

The drive shaft (40) includes the main shaft section (41) and an eccentric section (42). The main shaft section (41) is a substantially circular cylindrical member, and is supported by the upper bearing section (17) and the lower bearing section (18) so as to rotate about a shaft center (X) in the casing (10). The main shaft section (41) is formed so that an upper end portion thereof has a slightly larger diameter. On the other hand, the eccentric section (42) is formed in a circular cylindrical shape having a diameter smaller than that of the main shaft section (41), and is vertically arranged on an upper end surface of the main shaft section (41). The eccentric section (42) is provided so that a shaft center thereof is eccentric to the shaft center (X) of the main shaft section (41). In the drive shaft (40), a counter weight (43) provided on the main shaft section (41) and an oil supply pump (44) provided at an lower end of the main shall section (41) are also provided.

The counter weight (43) is provided near the eccentric section (42) on the main shaft section (41) in a state in which the counter weight (43) is eccentric to the shaft center (X) of the main shaft section (41) in a direction opposite to an eccentric direction of the eccentric section (42). The counter weight (43) is provided to maintain dynamic balance with a movable scroll (70), the eccentric section (42), etc.

The oil supply pump (44) is immersed in the low-pressure oil storage section (16) provided in the lower end portion of the casing (10), and is configured such that the lubricant oil stored in the low-pressure oil storage section (16) is drawn in association with rotation of the drive shaft (40).

An oil supply path (not shown in the figure) extending along the shaft center of the drive shaft (40) is formed in the drive shaft (40). The oil supply path is branched to portions of the main shaft section (41) supported by the upper and lower bearing sections (17, 18) and to each of sliding portions of the eccentric section (42) etc. That is, the lubricant oil drawn by the oil supply pump (44) is supplied to each of the sliding portions through the oil supply path.

Figure 2:
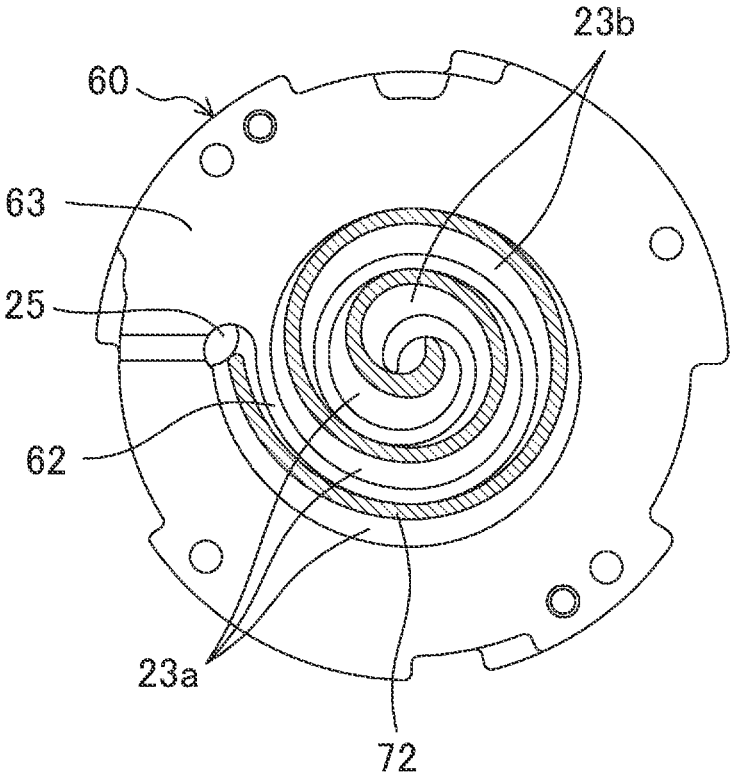
FIG. 2 is a cross-sectional view of a compression mechanism of the embodiment.

The compression mechanism (20) is arranged above the housing (50). As illustrated in FIGS. 1 and 2, the compression mechanism (20) includes a fixed scroll (60) and the movable scroll (70).

The fixed scroll (60) includes a substantially discoid fixed-scroll end plate (61), a spiral fixed-scroll wrap (62), an outer edge section (63) formed around the fixed-scroll wrap (62). The fixed-scroll wrap (62) is vertically arranged on a front surface (lower surface as viewed in FIG. 1) of the fixed-scroll end plate (61).

The fixed scroll (60) is fastened and fixed to the housing (50) with bolts. Note that an upper portion of an outer circumferential surface of the outer edge section (63) closely contacts an inner circumferential surface of the upper end plate (12). Thus, the inner space of the casing (10) is divided into an upper high-pressure space (22) filled with refrigerant discharged from the compression mechanism (20) and a lower low-pressure space (21) filled with refrigerant sucked into the compression mechanism (20). The outlet pipe (15) opens to the high-pressure space (22), and the inlet pipe (14) opens to the low-pressure space (21).

The movable scroll (70) includes a substantially discoid movable-scroll end plate (71), a spiral movable-scroll wrap (72), and a cylindrical boss section (73). The movable scroll (70) is mounted on an upper surface of the housing (50) through an Oldham's coupling (52). Note that the Oldham's coupling (52) prevents the movable scroll (70) from rotating during eccentric rotation of the movable scroll (70).

The movable-scroll wrap (72) is vertically arranged on a front surface (upper surface as viewed in FIG. 1) of the movable-scroll end plate (71). The movable-scroll wrap (72) is engaged with the fixed-scroll wrap (62). The scroll compressor (1) of the present embodiment has an asymmetric spiral structure in which the movable-scroll wrap (72) and the fixed-scroll wrap (62) are asymmetrically formed. The number of turns of the fixed-scroll wrap (62) (the length of a spiral of the fixed-scroll wrap (62)) is greater than that of the movable-scroll wrap (72) by substantially the half of a single turn. Note that, supposing that the spiral of the fixed-scroll wrap (62) extends to a position outside an inlet port (25) which will be described later, the number of turns of the fixed-scroll wrap (62) is counted.

The boss section (73) is vertically arranged on a back surface (lower surface as viewed in FIG. 1) of the movable-scroll end plate (71). The eccentric section (42) of the drive shaft (40) is inserted into the boss section (73).

As illustrated in FIG. 2, in the compression mechanism (20), a plurality of compression chambers (23) are formed between the fixed-scroll wrap (62) and the movable-scroll wrap (72). The plurality of compression chambers (23) are a first compression chamber (23*a*) formed between an inner surface of the fixed-scroll wrap (62) and an outer surface of the movable-scroll wrap (72), and a second compression chamber (23*b*) formed between an outer surface of the fixed-scroll wrap (62) and an inner surface of the movable-scroll wrap (72). The compression mechanism (20) is configured such that the compression ratio of the first compression chamber (23*a*) is greater than that of the second compression chamber (23*b*). Refrigerant flows into the first compression chamber (23*a*) from an outer side relative to an outer end of the movable-scroll wrap (72), and refrigerant flows into the second compression chamber (23*b*) from an inner side relative to the outer end of the movable-scroll wrap (72).

The inlet port (25) is formed in the fixed scroll (60) of the compression mechanism (20). The inlet port (25) is formed in the outer edge section (63) so as to open near an outermost portion of the fixed-scroll wrap (62). The inlet port (25) communicates with the low-pressure space (21) through a communication port which is not shown in the figure. The inlet port (25) intermittently communicates with each of the first compression chamber (23*a*) and the second compression chamber (23*b*) in association with the eccentric rotation of the movable scroll (70).

In addition, an outlet port (64) is formed in the fixed scroll (60). The outlet port (64) is a through-hole formed in a center portion of the fixed-scroll end plate (61). An inlet of the outlet port (64) intermittently communicates with each of the first compression chamber (23*a*) and the second compression chamber (23*b*) in association with the eccentric rotation of the movable scroll (70). An outlet of the outlet port (64) opens to an outlet chamber (65) above the fixed scroll (60).

A relief port (67) for releasing refrigerant which is being compressed from the first compression chamber (23*a*) is provided in the fixed-scroll end plate (61). One end of the relief port (67) opens to the first compression chamber (23*a*) which is in a compression phase, and the other end of the relief port (67) opens to the high-pressure space (22). In addition, a relief valve (68) for opening/closing the relief port (67) is provided in the fixed-scroll end plate (61). The relief valve (68) includes a reed valve and a valve guard. In the present embodiment, the relief port (67) is formed so as to communicate with the first compression chamber (23*a*) after a back-pressure supply hole (80) which will be described later communicates with the first compression chamber (23*a*).

In the present embodiment, a pressing mechanism (75) for pressing the movable scroll (70) against the fixed scroll (60) is provided. The pressing mechanism (75) includes a back-pressure chamber (53) facing the back surface of the movable-scroll end plate (71), and the back-pressure supply path (80) for introducing refrigerant of the first compression chamber (23*a*) into the back-pressure chamber (53). The pressing mechanism (75) is configured so as to press the movable scroll (70) against the fixed scroll (60) by refrigerant introduced into the back-pressure chamber (53) through the back-pressure supply path (80).

Figure 3:
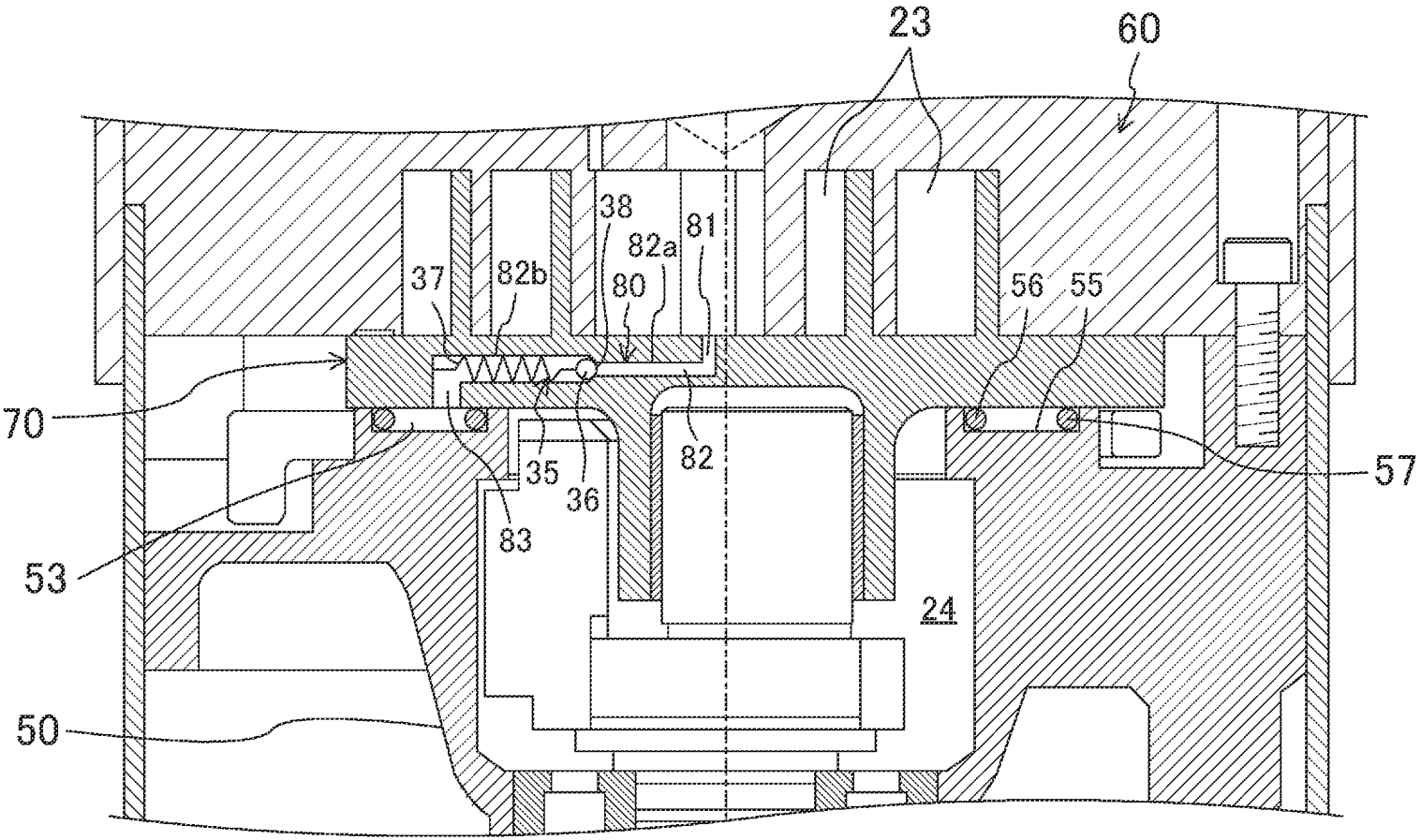
FIG. 3 is a longitudinal sectional view of a substantial part of the scroll compressor of the embodiment.

Specifically, as illustrated in FIG. 3, the back-pressure chamber (53) is formed by an inner seal ring (56) and an outer seal ring (57) which are arranged in a circular groove (55) formed in the upper surface of the housing (50). The outer seal ring (57) is formed so as to have a diameter larger than that of the inner seal ring (56). The height of the inner seal ring (56) and the outer seal ring (57) is set to a value larger than the depth of the groove (55). The inner seal ring (56) and the outer seal ring (57) are sandwiched between the back surface of the movable-scroll end plate (71) and a bottom surface of the groove (55). The inner seal ring (56), the outer seal ring (57), the back surface of the movable-scroll end plate (71), and the bottom surface of the groove (55) define an inner side, an outer side, an upper side, and a lower side of the back-pressure chamber (53), respectively. The back-pressure chamber (53) is a circular space.

The back-pressure supply path (80) is the single back-pressure supply hole (80) extending from the front surface to the back surface of the movable-scroll end plate (71). The back-pressure supply hole (80) has a circular cross section across the entire length thereof. The back-pressure supply hole (80) includes an inlet section (81), a middle section (82), and an outlet section (83). The inlet section (81) extends from the front surface of the movable-scroll end plate (71) in a downward direction (a thickness direction of the movable-scroll end plate (71)). The middle section (82) extends straight from a lower end of the inlet section (81) toward the periphery. The outlet section (83) extends straight from an outer end of the middle section (82) in the downward direction. The inner diameter of the back-pressure supply hole (80) is increased in the middle of the middle section (82). The middle section (82) includes a small-diameter region (82*a*) and a large-diameter region (82*h*).

Figure 4:
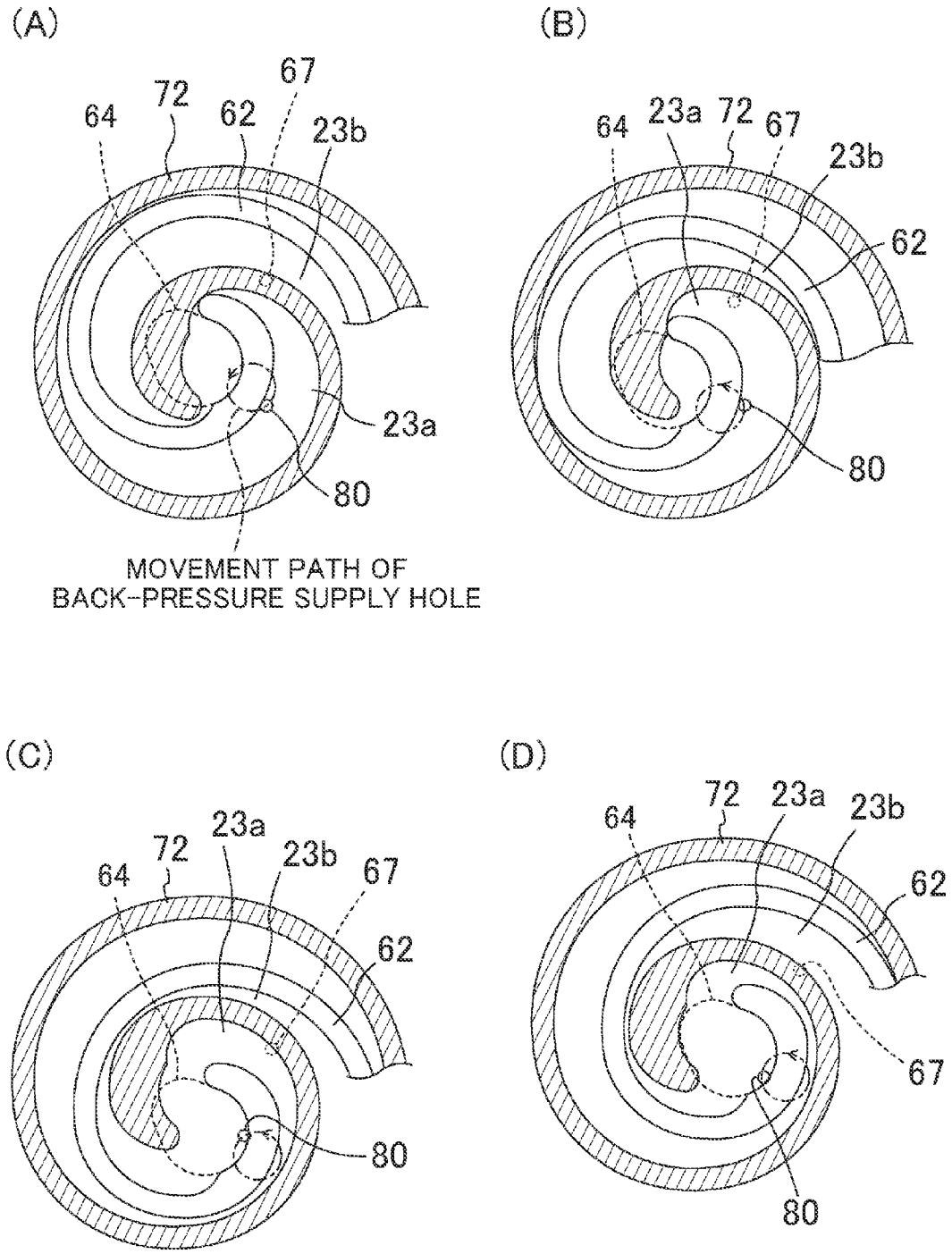
FIGS. 4(A)-4(D) are cross-sectional views illustrating an operation of the compression mechanism of the embodiment.

An inlet of the back-pressure supply hole (80) opens near an end portion of a spiral of the movable-scroll wrap (72) on an inner circumferential side. The position of the inlet of the back-pressure supply hole (80) is determined so that the inlet of the back-pressure supply hole (80) communicates with the first compression chamber (23*a*) right before the outlet port (64) communicates with the first compression chamber (23*a*) as illustrated in FIG. 4(B) and communicates with the first compression chamber (23*a*) communicating with the outlet port (64) as illustrated in FIG. 4(C). That is, when over-compression is caused, i.e., when the internal pressure of the first compression chamber (23*a*) right before the first compression chamber (23*a*) communicates with the outlet port (64) is higher than discharge pressure which is the pressure of the high-pressure space (22), the inlet of the back-pressure supply hole (80) communicates with the first compression chamber (23*a*) which is in an over-compression state in which the internal pressure of the first compression chamber (23*a*) is higher than the discharge pressure. In addition, when insufficient compression is caused, i.e., when the internal pressure of the first compression chamber (23*a*) right before the first compression chamber (23*a*) communicates with the outlet port (64) is lower than the discharge pressure, the inlet of the back-pressure supply hole (80) communicates with the first compression chamber (23*a*) which is in a state in which the internal pressure of the first compression chamber (23*a*) is increased to the discharge pressure.

In the present embodiment, a back-flow prevention mechanism (35) is provided, which is for allowing refrigerant to flow from the first compression chamber (23*a*) to the back-pressure chamber (53) in the back-pressure supply hole (80) and preventing refrigerant from flowing back from the back-pressure chamber (53) to the first compression chamber (23*a*) in the back-pressure supply hole (80). The back-flow prevention mechanism (35) is a check valve and is provided in the back-pressure supply hole (80). The back-flow prevention mechanism (35) includes a ball-shaped valve member (36) and an elastic member (37) which is an elastic spring.

The valve member (36) is provided in the large-diameter region (82*b*) of the middle section (82) of the back-pressure supply hole (80). The diameter of the valve member (36) is smaller than that of the large-diameter region (82*b*). The valve member (36) is pressed against a valve seat (38) provided on an inlet-side wall surface of the large-diameter region (82*b*) by the elastic member (37).

When the internal pressure of the first compression chamber (23*a*) exceeds the internal pressure of the back-pressure chamber (53), the elastic member (37) is contracted, and therefore the valve member (36) is separated from the valve seat (38) in association with the contraction of the elastic member (37). In such a manner, the back-flow prevention mechanism (35) is in an open state which allows refrigerant to flow from the first compression chamber (23*a*) to the back-pressure chamber (53). On the other hand, when the internal pressure of the first compression chamber (23*a*) is equal to or less than the internal pressure of the back-pressure chamber (53), the valve member (36) is pressed against the valve seat (38) by the elastic member (37). In such a manner, the back-flow prevention mechanism (35) is in a closed state which prevents refrigerant from flowing back from the back-pressure chamber (53) to the first compression chamber (23*a*).

Figure 5:
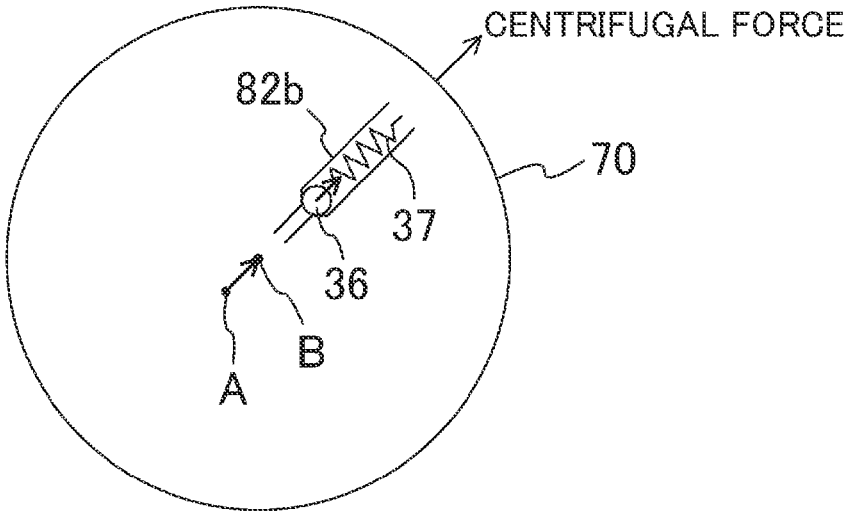
FIGS. 5(A) and 5(B) are cross-sectional views of a movable-scroll end plate of the embodiment.
Figure 5:
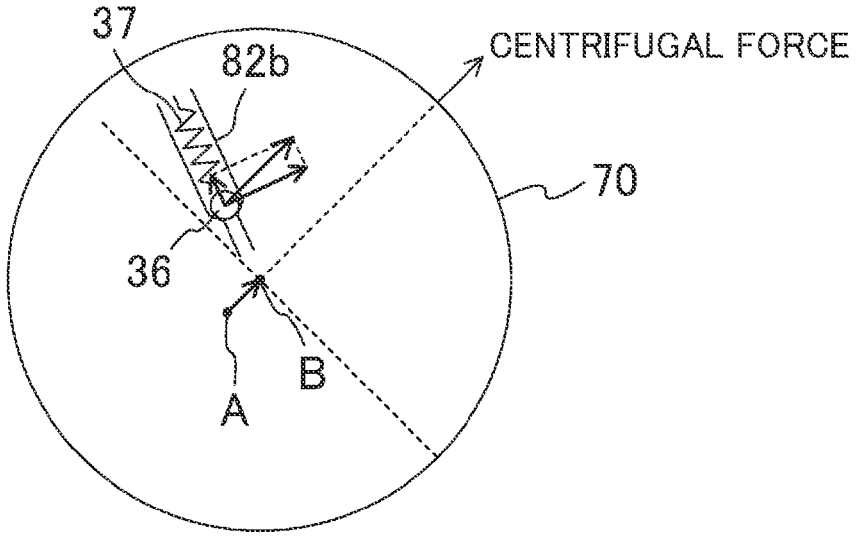

As illustrated in FIG. 5(A), in the present embodiment, the back-pressure supply hole (80) is formed so that, upon completion of the compression phase in the first compression chamber (23*a*) (at the time of changing from a state in which the outlet port (64) does not communicate with the first compression chamber (23*a*) into a state in which the outlet port (64) communicates with the first compression chamber (23*a*)), a direction (hereinafter referred to as a "first direction") in which the valve member (36) moves when the back-flow prevention mechanism (35) is switched from the closed state to the open state is coincident with a direction (hereinafter referred to as a "second direction") of a line from a shaft center (A) of the main shaft section (41) toward a shaft center (B) of the eccentric section (42) as viewed in an axial direction of the drive shaft (40). That is, upon the completion of the compression phase in the first compression chamber 23*a*), the angle between the first and second directions is 0° as viewed in the axial direction of the drive shaft (40).

Specifically, upon the completion of the compression phase in the first compression chamber (23*a*), a direction in which the middle section (82) of the back-pressure supply hole (80) extends is coincident with an eccentric direction of the movable scroll (70). The inlet section (81) of the back-pressure supply hole (80) is positioned on a side closer to the center of the scroll compressor (1), and the outlet section (83) of the back-pressure supply hole (80) is positioned on a side closer to the periphery of the scroll compressor (1).

The foregoing configuration allows that, upon the completion of the compression phase in the first compression chamber (23*a*), the direction of centrifugal force acting on the valve member (36) is coincident with the first direction. That is, when the internal pressure of the first compression chamber (23*a*) reaches the maximum pressure, if the over-compression is caused, the direction of centrifugal force acting on the valve member (36) is coincident with the first direction. Thus, when the over-compression is caused, even if the difference between force acting on the valve member (36) from a side closer to the first compression chamber (23*a*) and force acting on the valve member (36) from a side closer to the back-pressure chamber (53) is small under the maximum internal pressure of the first compression chamber (23*a*), i.e., even if the difference between the internal pressure of the first compression chamber (23*a*) and the internal pressure of the back-pressure chamber (53) is small, the valve member (36) moves in the first direction. That is, the back-flow prevention mechanism (35) can be easily opened.

Note that, supposing that a rotation direction of the drive shaft (40) is the positive direction, the angle (α) between the first and second directions may be equal to or greater than −90° and equal to or less than 90° as viewed in the axial direction of the drive shaft (40) in order to easily open the back-flow prevention mechanism (35) upon the completion of the compression phase in the first compression chamber (23*a*). That is, when the crank angle of the drive shaft (40) upon the completion of the compression phase in the first compression chamber (23*a*) is θ (degrees), if the crank angle θ is a predetermined angle of equal to or greater than −90° and equal to or less than 90°, the first and second directions may be coincident with each other as viewed in the axial direction of the drive shaft (40).

It is more preferable that, supposing that the rotation direction of the drive shaft (40) is the positive direction, the angle (α) between the first and second directions may be equal to or greater than 0° and equal to or less than 90° as viewed in the axial direction of the drive shaft (40) upon the completion of the compression phase in the first compression chamber (23*a*). In such a state, the magnitude of a first-direction component of centrifugal force acting on the valve member (36) is maximum before the completion of the compression phase in the first compression chamber (23*a*). Thus, after the completion of the compression phase in the first compression chamber (23*a*), the valve member (36) is easily and quickly returned to a position contacting the valve seat (38).

Specifically, as illustrated in FIG. 5(B), if the angle (α) between the first and second directions is a value closer to 90° (e.g., 80°), the magnitude of the first-direction component of centrifugal force acting on the valve member (36) is relatively small. The magnitude of the first-direction component tends to decrease from a peak value. Thus, the magnitude of the first-direction component right after the completion of the compression phase in the first compression chamber (23*a*) is represented by a negative value. As a result, after the completion of the compression phase in the first compression chamber (23*a*), the valve member (36) is easily and quickly returned to the position contacting the valve seat (38).

Operation

Next, an operation of the scroll compressor (1) will be described.

In the scroll compressor (1) of the present embodiment, when power is applied to the electric motor (30), the drive shaft (40) rotates to eccentrically rotate the movable scroll (70). Note that FIGS. 4(A)-4(D) illustrate a change in position of the movable scroll (70) in association with the rotation of the drive shaft (40). In FIG. 4(A)-4(D), the position of the movable scroll (70) is changed in order of (A), (B), (C), and (D).

While the first compression chamber (23*a*) or the second compression chamber (23*b*) communicates with the inlet port (25), the first compression chamber (23*a*) or the second compression chamber (23*b*) is in a suction phase in which refrigerant of the low pressure space (21) is sucked through the inlet port (25). During the suction phase, refrigerant is sucked into the compression chamber (23*a*, 23*b*) in association with an increase in volume of the compression chamber (23*a*, 23*b*). The suction phase is completed when the compression chamber (23*a*, 23*b*) is isolated from the inlet port (25), and then a compression phase in which refrigerant is compressed is started.

During the compression phase, the compression chamber (23*a*, 23*b*) moves toward the center while decreasing the volume of the compression chamber (23*a*, 23*b*) in association with the rotation of the movable scroll (70). In such a state, refrigerant of the compression chamber (23*a*, 23*b*) is compressed. In the compression chamber (23*a*, 23*b*), the compression phase is performed until the compression chamber (23*a*, 23*b*) communicates with the outlet port (64). When the outlet port (64) communicates with the compression chamber (23*a*, 23*b*), a discharge phase in which refrigerant is discharged through the outlet port (64) is started. During the discharge phase, refrigerant is discharged from the compression chamber (23*a*, 23*b*) through the outlet pipe (15).

In the present embodiment, the inlet of the back-pressure supply hole (80) communicates with the first compression chamber (23*a*) in the second half of the compression phase. The inlet of the back-pressure supply hole (80) communicates with the first compression chamber (23*a*) while the movable scroll (70) moves from the position illustrated in FIG. 4(A) to the position illustrated in FIG. 4(B). The inlet of the back-pressure supply hole (80) communicates with the first compression chamber (23*a*) right before the first compression chamber (23*a*) communicates with the outlet port (64). Note that the inlet of the back-pressure supply hole (80) communicates with the first compression chamber (23*a*) before the relief port (67) communicates with the first compression chamber (23*a*).

In addition, the inlet of the back-pressure supply hole (80) also communicates with the first compression chamber (23*a*) during the discharge phase. The inlet of the back-pressure supply hole (80) communicates with the first compression chamber (23*a*) while the movable scroll (70) moves from the position illustrated in FIG. 4(C) to the position illustrated in FIG. 4(D). The inlet of the back-pressure supply hole (80) communicates with the first compression chamber (23*a*) communicating with the outlet port (64).

Figure 6:
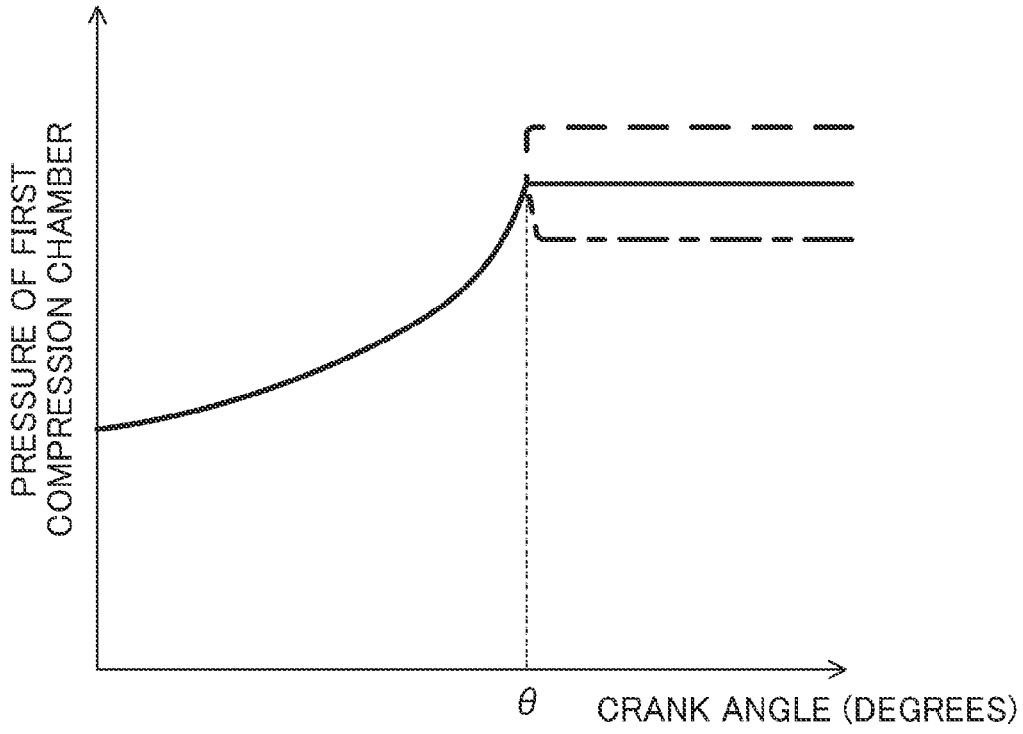
FIG. 6 is a graph illustrating a change in pressure of a compression chamber in the embodiment.

As illustrated in FIG. 6, when the over-compression is caused under an operation condition of low differential pressure, the internal pressure of the first compression chamber (23*a*) right before the first compression chamber (23*a*) communicates with the outlet port (64) is higher than the discharge pressure, and the internal pressure of the first compression chamber (23*a*) communicating with the outlet port (64) is equal to the discharge pressure. That is, the internal pressure of the first compression chamber (23*a*) right before the first compression chamber (23*a*) communicates with the outlet port (64) is higher than that of the first compression chamber (23*a*) communicating with the outlet port (64). In association with the rotation of the movable scroll (70), the inlet of the back-pressure supply hole (80) communicates alternately with the first compression chamber (23*a*) having high internal pressure and the first compression chamber (23*a*) having low internal pressure.

In FIG. 6, a change in internal pressure of the first compression chamber (23*a*) when neither the over-compression nor the insufficient compression is caused is represented by a solid line. In addition, a change in internal pressure of the first compression chamber (23*a*) when the over-compression is caused is represented by a dashed-dotted line, and a change in internal pressure of the first compression chamber (23*a*) when the insufficient compression is caused is represented by a dashed line.

On the other hand, when the insufficient compression is caused under an operation condition of high differential pressure, the internal pressure of the first compression chamber (23*a*) right before the first compression chamber (23*a*) communicates with the outlet port (64) is lower than the discharge pressure, and the internal pressure of the first compression chamber (23*a*) communicating with the outlet port (64) is equal to the discharge pressure. That is, the internal pressure of the first compression chamber (23*a*) communicating with the outlet port (64) is higher than that of the first compression chamber (23*a*) right before the first compression chamber (23*a*) communicates with the outlet port (64). As in the case where the over-compression is caused, the inlet of the back-pressure supply hole (80) communicates alternately with the first compression chamber (23*a*) having high internal pressure and the first compression chamber (23*a*) having low internal pressure in association with the rotation of the movable scroll (70).

In the back-pressure supply hole (80), the back-flow prevention mechanism (35) prevents refrigerant from flowing back from the back-pressure chamber (53) to the first compression chamber (23*a*). Thus, when the inlet of the back-pressure supply hole (80) communicates with the first compression chamber (23*a*) having high internal pressure, the back-flow prevention mechanism (35) is in the open state, and refrigerant is introduced into the back-pressure chamber (53) from the first compression chamber (23*a*). On the other hand, when the inlet of the back-pressure supply hole (80) communicates with the first compression chamber (23*a*) having low internal pressure, the back-flow prevention mechanism (35) is in the closed state, and refrigerant of the back-pressure chamber (53) is prevented from returning to the first compression chamber (23*a*). By providing the back-flow prevention mechanism (35), a decrease in internal pressure of the back-pressure chamber (53) due to returning of refrigerant of the back-pressure chamber (53) to the first compression chamber (23*a*) is, to some extent, avoided when the back-pressure supply path (80) communicates with the first compression chamber (23*a*) having low internal pressure. The internal pressure of the back-pressure chamber (53) is adjust so as to approach the high internal pressure of the first compression chamber (23*a*).

Thus, when the over-compression is caused, the internal pressure of the back-pressure chamber (53) is adjusted so as to approach the internal pressure of the first compression chamber (23*a*) right before the first compression chamber (23*a*) communicates with the outlet port (64). On the other hand, when the insufficient compression is caused, the internal pressure of the back-pressure chamber (53) is adjusted so as to approach the internal pressure of the first compression chamber (23*a*) communicating with the outlet port (64). In the present embodiment, even if any of the over-compression and the insufficient compression are caused, the internal pressure of the back-pressure chamber (53) is adjusted so as to approach the maximum pressure in a pressure change of refrigerant in the first compression chamber (23*a*). Finally, the internal pressure of the back-pressure chamber (53) is maintained at the pressure substantially equal to the maximum pressure in the pressure change of refrigerant in the first compression chamber (23*a*).

Advantages of Embodiment

In the present embodiment, even if any of the over-compression and the insufficient compression are caused, the back-pressure supply path (80) communicates with the first compression chamber (23*a*) having the maximum pressure in the pressure change of refrigerant, and the decrease in internal pressure of the back-pressure chamber (53) is prevented by the back-flow prevention mechanism (35). Thus, the internal pressure of the back-pressure chamber (53) is maintained at the pressure close to or equal to the maximum pressure in the pressure change of refrigerant in the first compression chamber (23*a*). The maximum pressure in the pressure change of refrigerant results in the maximum separating force. In the present embodiment, the internal pressure of the back-pressure chamber (53) is adjusted to the pressure when the separating force is maximum in any of the foregoing cases. Thus, lack of the pressing force against the separating force can be avoided under any operation conditions. Degradation of compression efficiency which is caused as follows can be avoided: the movable scroll (70) is inclined due to the lack of the pressing force and refrigerant leaks from the compression chamber (23*a*, 23*b*) due to the inclination of the movable scroll (70).

In the present embodiment, since the relief port (67) communicates with the first compression chamber (23*a*) after the back-pressure supply path (80) communicates with the first compression chamber (23*a*), refrigerant is introduced into the back-pressure chamber (53) from the first compression chamber (23*a*) before the pressure of the first compression chamber (23*a*) is decreased by the relief port (67). Thus, when the over-compression is caused, the pressing force can be ensured by introducing high-pressure refrigerant into the back-pressure chamber (53) while reducing the degree of over-compression.

In the present embodiment, right before the outlet port (64) communicates with the first compression chamber (23*a*), the back-pressure supply path (80) communicates only with the first compression chamber (23*a*) having a compression ratio greater than that of the second compression chamber (23*b*). Thus, when the over-compression is caused, the internal pressure of the back-pressure chamber (53) is adjusted to the higher one of the maximum pressure of the first compression chamber (23*a*) or the maximum pressure of the second compression chamber (23*b*). Consequently, the great pressing force can be obtained, and therefore it can be ensued that the lack of the pressing force against the separating force is avoided.

In the present embodiment, when the over-compression is caused, the magnitude of the first-direction component of centrifugal force acting on the valve member (36) is equal to or greater than zero when the internal pressure of the first compression chamber (23*a*) reaches the maximum pressure. Thus, even if the difference between the internal pressure of the first compression chamber (23*a*) and the internal pressure of the back-pressure chamber (53) is small, the valve member (36) moves to the position where refrigerant circulation is allowed. Consequently, the internal pressure of the back-pressure chamber (53) can be increased to higher pressure.

In the present embodiment, the magnitude of the first-direction component of centrifugal force acting on the valve member (36) is maximum before the internal pressure of the first compression chamber (23*a*) reaches the maximum pressure. After the foregoing point of time, the valve member (36) is easily and quickly returned to the position where the refrigerant circulation is prevented. Thus, when the over-compression is caused, an increase in time for which the back-pressure chamber (53) communicates with the first compression chamber (23*a*) having the pressure reduced by communicating with the outlet port (64) can be avoided. Consequently, a decrease in pressure of the back-pressure chamber (53) can be reduced.

First Variation of Embodiment

Figure 7:
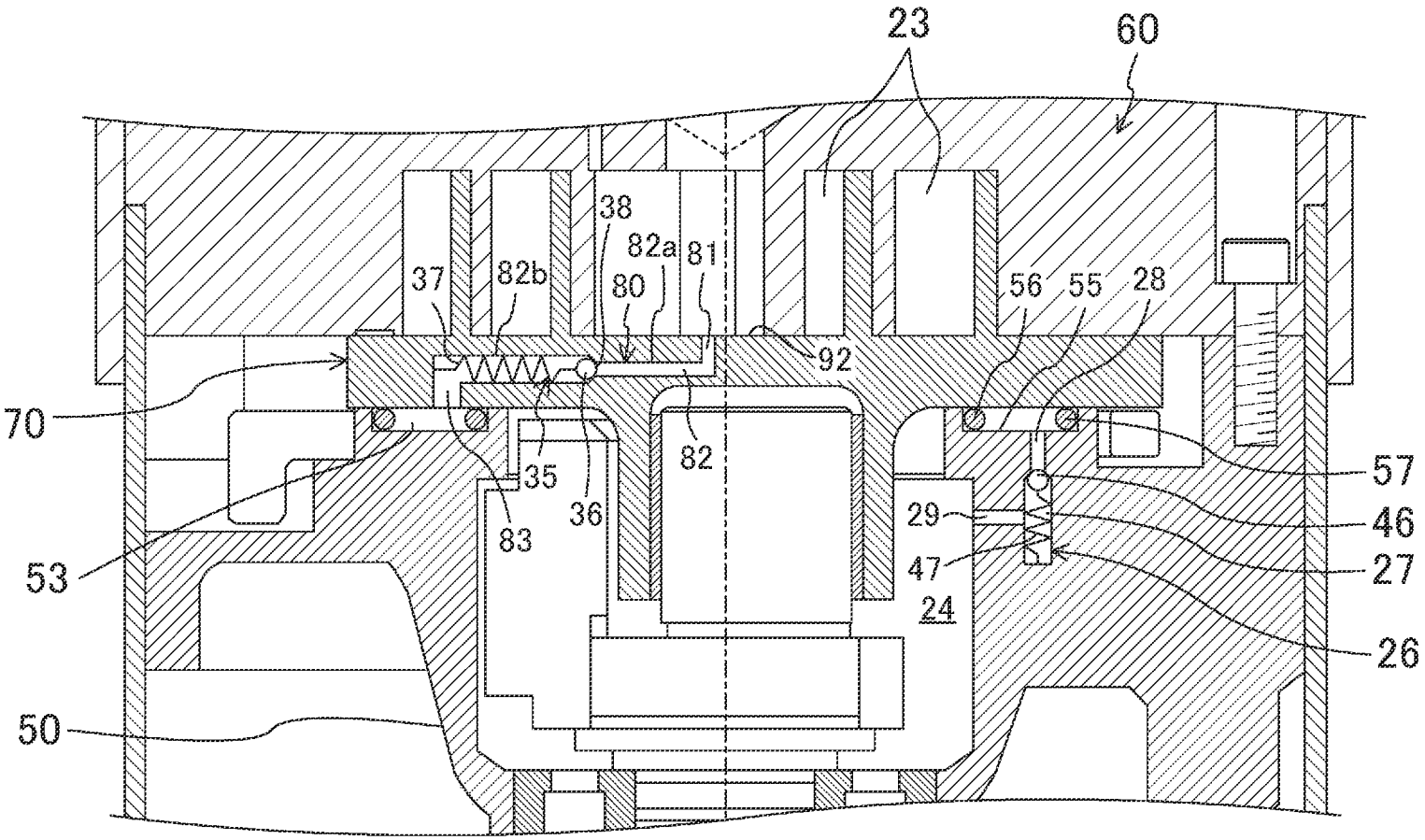
FIG. 7 is a longitudinal sectional view of a substantial part of a scroll compressor of a first variation of the embodiment.

In a first variation, a scroll compressor (1) includes a back-pressure reduction mechanism (26) as illustrated in FIG. 7. The back-pressure reduction mechanism (26) is a check valve.

Specifically, in a housing (50), an accommodation chamber (27) for accommodating the back-pressure reduction mechanism (26), an inlet path (28) for allowing a back-pressure chamber (53) to communicate with the accommodation chamber (27), and an outlet path (29) for allowing the accommodation chamber (27) to communicate with an shaft-side space (24) formed between an inner surface of the housing (50) and an outer surface of a drive shaft (40) are formed.

Note that the shaft-side space (24) communicates with a low-pressure space (21). Thus, the shaft-side space (24) communicates with a compression chamber (23) which is in a suction phase, through an inlet port (25). The internal pressure of the shaft-side space (24) is equal to that of the compression chamber (23) which is in the suction phase. The shaft-side space (24) is an inlet space (24).

The accommodation chamber (27) is a space having a circular cross section and extending in the vertical direction. One end of the inlet path (28) opens at a bottom surface of a groove (55), and the other end of the inlet path (28) opens at an upper end of the accommodation chamber (27). The inlet path (28) has a cross section with a diameter smaller than that of the accommodation chamber (27). This forms a valve seat for a back-pressure reduction valve member (46) which will be described later around the opening of the inlet path (28) in an upper wall surface of the accommodation chamber (27). In addition, one end of the outlet path (29) opens at a wall surface of the accommodation chamber (27), and the other end of the outlet path (29) opens at an inner wall surface of the housing (50).

The back-pressure reduction mechanism (26) includes the substantially ball-shaped back-pressure reduction valve member (46) and a back-pressure reduction elastic member (47) which is an elastic spring. The back-pressure reduction valve member (46) is pressed against the valve seat of the upper wall surface of the accommodation chamber (27) by the back-pressure reduction elastic member (47).

In the back-pressure reduction mechanism (26), when the internal pressure of the back-pressure chamber (53) exceeds the internal pressure of the shaft-side space (24), i.e., when the internal pressure of the back-pressure chamber (53) exceeds the internal pressure of the compression chamber (23) which is in the suction phase, the back-pressure reduction valve member (46) is contracted and moves downward so as to be apart from the valve seat. The back-pressure reduction valve member (46) moves downward as the difference between the internal pressure of the back-pressure chamber (53) and the internal pressure of the compression chamber (23) which is in the suction phase is increased. When the difference between the internal pressure of the back-pressure chamber (53) and the internal pressure of the compression chamber (23) which is in the suction phase is equal to or greater than a predetermined differential pressure reference value, the back-pressure reduction valve member (46) moves to a point lower than a level at which the opening of the outlet path (29) is closed. Then, the back-pressure chamber (53) and the shaft-side space (24) communicate with each other, and the back-pressure reduction mechanism (26) is in an open state. When the back-pressure chamber (53) and the shaft-side space (24) communicate with each other, refrigerant of the back-pressure chamber (53) flows into the shaft-side space (24), thereby reducing the internal pressure of the back-pressure chamber (53).

Note that the differential pressure reference value is set so that the back-pressure reduction mechanism (26) is not in the open state when over-compression is caused and is in the open state only when insufficient compression is caused. Specifically, the differential pressure reference value is set so as to be lower than an estimated value of differential pressure between the internal pressure of the compression chamber (23) which is in the suction phase and the internal pressure of the compression chamber (23) upon completion of a compression phase. An estimated value of the internal pressure of the compression chamber (23) which is in the suction phase can be obtained based on, e.g., an estimated evaporation temperature of an evaporator in a refrigerant circuit, and an estimated value of the internal pressure of the compression chamber (23) upon the completion of the compression phase can be obtained by multiplying the estimated value of the internal pressure of the compression chamber (23) which is in the suction phase by the compression ratio of a compression mechanism (20).

In the first variation, when the insufficient compression is caused, the internal pressure of the back-pressure chamber (53) is reduced by the back-pressure reduction mechanism (26), thereby decreasing the difference between the internal pressure of the back-pressure chamber (53) and the internal pressure of the compression chamber (23) which is in the suction phase. That is, the difference between pressing force and separating force can be decreased. Thus, when the insufficient compression is caused, excessive thrust loss can be reduced.

Second Variation of Embodiment

Figure 8:
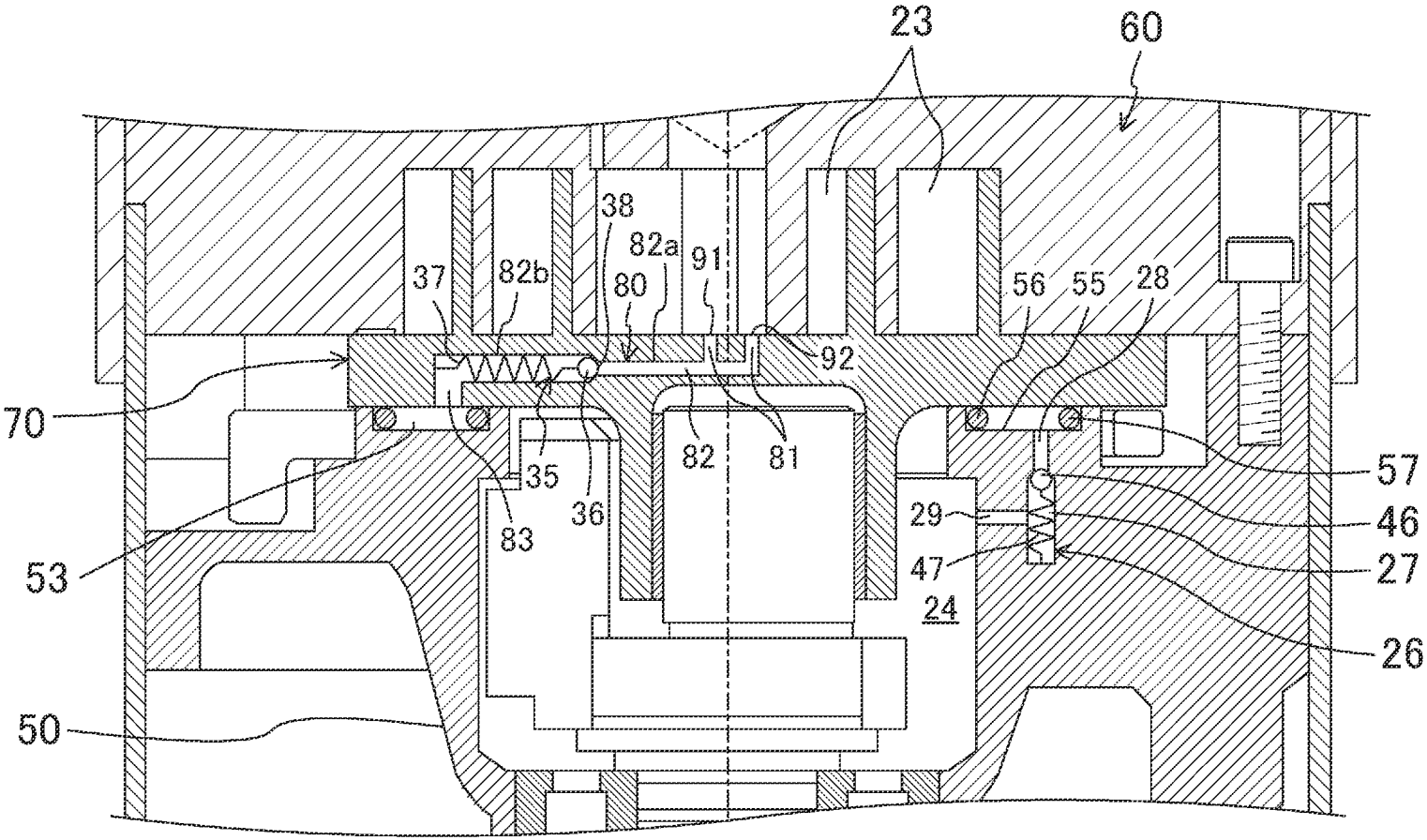
FIG. 8 is a longitudinal sectional view of a substantial part of a scroll compressor of a second variation of the embodiment.
Figure 9:
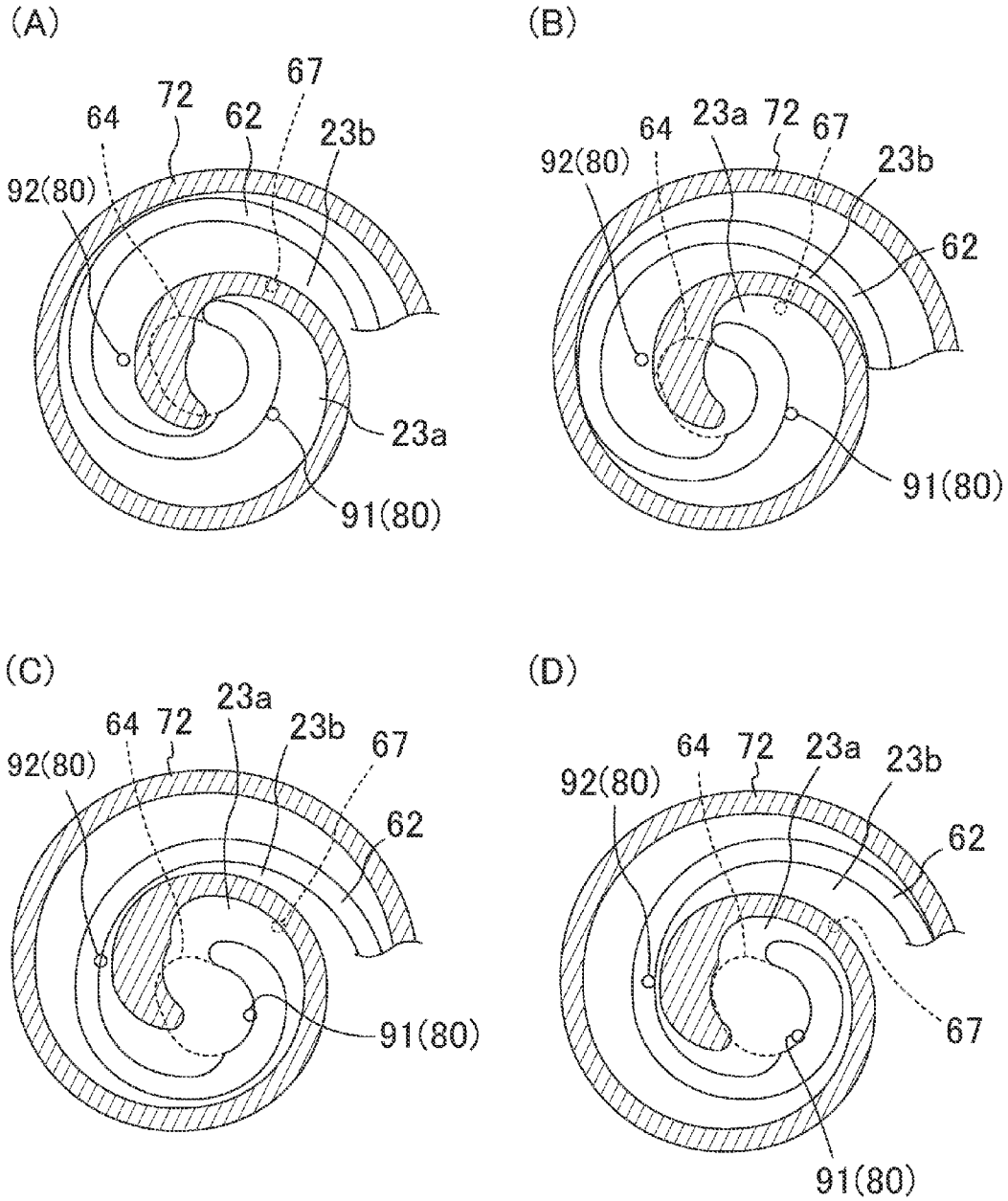
FIGS. 9(A)-9(D) are cross-sectional views illustrating an operation of a compression mechanism of the second variation of the embodiment.

In a second variation, an back-pressure supply path (80) includes, as illustrated in FIGS. 8 and 9, a first inlet (91) communicating with a first compression chamber (23*a*) right before the first compression chamber (23*a*) communicates with an outlet port (64), and a second inlet (92) communicating with a second compression chamber (23*b*) right before the second compression chamber (23*b*) communicates with the outlet port (64). In the back-pressure supply path (80), a path extending from the first inlet (91) and a path extending from the second inlet (92) are joined together on a side closer to a compression chamber (23) relative to a back-flow prevention mechanism (35).

In the second variation, the back-pressure chamber (53) communicates with both of the first compression chamber (23*a*) right before the first compression chamber (23*a*) communicates with the outlet port (64) and the second compression chamber (23*b*) right before the second compression chamber (23*b*) communicates with the outlet port (64). Thus, a time for which the back-pressure chamber (53) communicates with the compression chamber (23) right before the compression chamber (23) communicates with the outlet port (64) is longer than a time for which the back-pressure chamber (53) communicates only with one of the first compression chamber (23*a*) or the second compression chamber (23*b*). Consequently, when over-compression is caused, it is likely that refrigerant of the compression chamber (23) right before the compression chamber (23) communicates with the outlet port (64) is introduced into the back-pressure chamber (53), and therefore it can be ensured that the internal pressure of the back-pressure chamber (53) is stably increased.

Note that the back-pressure supply path (80) may include a first back-pressure supply hole (80*a*) having the first inlet (91)

communicating with the first compression chamber (23*a*) right before the first compression chamber (23*a*) communicates with the outlet port (64), and a second back-pressure supply hole (80*b*) having the second inlet (92) communicating with the second compression chamber (23*b*) right before the second compression chamber (23*b*) communicates with the outlet port (64). Each of outlets of the back-pressure supply holes (80*a*, 80*b*) communicates with the back-pressure chamber (53). In addition, back-flow prevention mechanisms (35*a*, 35*b*) are provided in the back-pressure supply holes (80*a*, 80*b*), respectively.

In such a case, in a manner where the pressing force of the valve member (36) by the elastic member (37) is smaller in one of the back-flow prevention mechanisms (35*a*, 35*b*) of the back-pressure supply holes (80*a*, 80*b*) corresponding to one of the compression chambers (23*a*, 23*b*) with a lower compression ratio than in the other one of the back-flow prevention mechanisms (35*a*, 35*b*), refrigerant can be, to some extent, uniformly introduced from both of the compression chambers (23*a*, 23*b*).

Other Embodiment

The foregoing embodiment may have the following configurations.

The foregoing embodiment may have a symmetric spiral structure in which the movable-scroll wrap (72) and the fixed-scroll wrap (62) are symmetrically formed.

In the foregoing embodiment, the position of the inlet of the back-pressure supply path (80) may be determined so that the inlet of the back-pressure supply path (80) continuously communicates with the compression chamber (23) right before the compression chamber (23) communicates with the outlet port (64) and right after the compression chamber (23) communicates with the outlet port (64).

Note that the foregoing embodiment has been set forth merely for purposes of preferred examples in nature, and is not intended to limit the scope, applications, and use of the invention.

INDUSTRIAL APPLICABILITY

As described above, the present invention is useful for the scroll compressor including the mechanism for pressing the movable scroll against the fixed scroll.

What is claimed is:

1. A scroll compressor comprising:

a fixed scroll having an outlet port;

a movable scroll engaged with the fixed scroll, the movable scroll having a movable-scroll end plate with a back surface;

two compression chambers formed by the movable scroll engaged together with the fixed scroll, the fixed scroll and the movable scroll being configured to compress a fluid in each compression chamber by driving the movable scroll;

a pressing mechanism including a back-pressure chamber facing the back surface of the movable-scroll end plate of the movable scroll, and a back-pressure supply path arranged to move to opposite inner and outer sides of a stationary lap of the stationary scroll as the movable scroll is driven in order to allow the back-pressure chamber to alternately communicate with one of the compression chambers when the one of the compression chambers is in a state right before the one of the compression chambers communicates with the outlet port and a state in which the one of the compression chambers communicates with the outlet port, the pressing mechanism being configured to press the movable scroll against the fixed scroll by internal pressure of the back-pressure chamber; and a back-flow prevention mechanism including a valve member configured to allow fluid of the back-pressure supply path to flow from each compression chamber to the back-pressure chamber and to prevent fluid of the back-pressure supply path from returning from the back-pressure chamber to each compression chamber.

2. The scroll compressor of claim 1, further comprising a casing in which the fixed scroll and the movable scroll are accommodated;

an inlet space formed in the casing, the inlet space communicating with the compression chamber when the compression chamber is in a fluid suction phase; and a back-pressure reduction mechanism including a valve member arranged to allow the back-pressure chamber to communicate with the inlet space when a difference between the internal pressure of the back-pressure chamber and internal pressure of the inlet space is equal to or higher than a predetermined differential pressure reference value.

3. The scroll compressor of claim 2, wherein a relief port is formed in the fixed scroll and arranged to release fluid which is being compressed from the compression chamber communicating with the back-pressure supply path right before the compression chamber communicates with the outlet port so as to communicate with the compression chamber after the back-pressure supply path communicates with the compression chamber.

4. The scroll compressor of claim 2, wherein the fixed scroll includes a fixed-scroll wrap having an inner surface and an outer surface, the movable scroll includes a movable-scroll wrap having an inner surface and an outer surface, the compression chamber includes a first compression chamber formed between the inner surface of the fixed-scroll wrap of the fixed scroll and die outer surface of the movable-scroll wrap of the movable scroll, and a second compression chamber formed between die outer surface of the fixed-scroll wrap and the inner surface of the movable-scroll wrap, the movable scroll and the fixed scroll are configured such that a compression ratio of the first compression chamber and a compression ratio of the second compression chamber are different from each other, and the back-pressure supply path communicates only with the first compression chamber having a higher compression ratio than that of the second compression chamber right before the outlet port communicates with the first compression chamber.

5. The scroll compressor of claim 2, wherein the fixed scroll includes a fixed-scroll wrap having an inner surface and an outer surface, the movable scroll includes a movable-scroll wrap having an inner surface and an outer surface, the compression chamber includes a first compression chamber formed between the inner surface of the fixed-scroll wrap of the fixed scroll and the outer surface of the movable-scroll wrap of the movable scroll, and a second compression chamber formed between the outer surface of the fixed-scroll wrap and the inner surface of the movable-scroll wrap, and the back-pressure supply path includes a first inlet communicating with the first compression chamber right before the first compression chamber communicates with the outlet port, and a second inlet communicating with the second compression chamber right before the second compression chamber communicates with the outlet port.

6. The scroll compressor of claim 2, further comprising:

a drive shaft including a main shaft section and an eccentric section engaged with the movable scroll so as to be eccentric to the main shaft section, the main shaft section having a main shaft center and the eccentric section having an eccentric shaft center, the back-pressure supply path being formed in the movable scroll, the valve member of the back-flow prevention mechanism moving in a predetermined first direction when the back-flow prevention mechanism is switched from a state in which fluid circulation in the back-pressure supply path is prevented to a state in which the fluid circulation in the back-pressure supply path is allowed, and an angle between the first direction and a second direction which is a direction of a line from the main shaft center of the main shaft section toward the eccentric shaft center of the eccentric section being equal to or greater than −90° and equal to or less than 90° as viewed in an axial direction of the drive shaft when the outlet port comes to communicate with the compression chamber communicating with the back-pressure supply path, when a rotation direction of the drive shaft is a positive direction.

7. The scroll compressor of claim 1, wherein a relief port is formed in the fixed scroll and arranged to release fluid which is being compressed from the compression chamber communicating with the back-pressure supply path right before the compression chamber communicates with the outlet port so as to communicate with the compression chamber after the back-pressure supply path communicates with the compression chamber.

8. The scroll compressor of claim 7, wherein the fixed scroll includes a fixed-scroll wrap having an inner surface and an outer surface, the movable scroll includes a movable-scroll wrap having an inner surface and an outer surface, the compression chamber includes a first compression chamber formed between the inner surface of the fixed-scroll wrap of the fixed scroll and the outer surface of the movable-scroll wrap of the movable scroll, and a second compression chamber formed between the outer surface of the fixed-scroll wrap and the inner surface of the movable-scroll wrap, the movable scroll and the fixed scroll are configured such that a compression ratio of the first compression chamber and a compression ratio of the second compression chamber are different from each other, and the back-pressure supply path communicates only with the first compression chamber having a higher compression ratio than that of the second compression chamber right before the outlet port communicates with the first compression chamber.

9. The scroll compressor of claim 7, wherein the fixed scroll includes a fixed-scroll wrap having an inner surface and an outer surface, the movable scroll includes movable-scroll wrap having an inner surface and an outer surface, the compression chamber includes a first compression chamber formed between the inner surface of the fixed-scroll wrap of the fixed scroll and the outer surface of the movable-scroll wrap of the movable scroll, and a second compression chamber formed between the outer surface of the fixed-scroll wrap and the inner surface of the movable-scroll wrap, and the back-pressure supply path includes a first inlet communicating with the first compression chamber right before the first compression chamber communicates with the outlet port, and a second inlet communicating with the second compression chamber right before the second compression chamber communicates with the outlet port.

10. The scroll compressor of claim 7, further comprising:

a drive shaft including a main shaft section and an eccentric section engaged with the movable scroll so as to be eccentric to the main shaft section, the main shaft section having a main shaft center and the eccentric section having an eccentric shaft center, the back-pressure supply path being formed in the movable scroll, the valve member of the back-flow prevention mechanism moving in a predetermined first direction when the back-flow prevention mechanism is switched from a state in which fluid circulation in the back-pressure supply path is prevented to a state in which the fluid circulation in the back-pressure supply path is allowed, and an angle between the first direction and a second direction which is a direction of a line from the main shaft center of the main shaft section toward the eccentric shaft center of the eccentric section being equal to or greater than −90° and equal to or less than 90° as viewed in an axial direction of the drive shaft when the outlet port comes to communicate with the compression chamber communicating with the back-pressure supply path, when a rotation direction of the drive shaft is a positive direction.

11. The scroll compressor of claim 1, wherein the fixed scroll includes a fixed-scroll wrap having an inner surface and an outer surface, the movable scroll includes a movable-scroll wrap having an inner surface and an outer surface, the compression chamber includes a first compression chamber formed between the inner surface of the fixed-scroll wrap of the fixed scroll and the outer surface of the movable-scroll wrap of the movable scroll, and a second compression chamber formed between the outer surface of the fixed-scroll wrap and the inner surface of the movable-scroll wrap, the movable scroll and the fixed scroll are configured such that a compression ratio of the first compression chamber and a compression ratio of the second compression chamber are different from each other, and the back-pressure supply path communicates only with the first compression chamber having a higher compression ratio than that of the second compression chamber right before the outlet port communicates with the first compression chamber.

12. The scroll compressor of claim 11, further comprising:

a drive shaft including a main shaft section and an eccentric section engaged with the movable scroll so as to be eccentric to the main shaft section, the main shaft section having a main shaft center and the eccentric section having an eccentric shaft center, the back-pressure supply path being formed in the movable scroll, the valve member of the back-flow prevention mechanism moving in a predetermined first direction when the back-flow prevention mechanism is switched from astute in which fluid circulation in the back-pressure supply path is prevented to a state in which the fluid circulation in the back-pressure supply path is allowed, and an angle between the first direction and a second direction which is a direction of a line from the main shaft center of the main shaft section toward the eccentric shaft center of the eccentric section being equal to or greater than −90° and equal to or less than 90° as viewed in an axial direction of the drive shaft when the outlet port comes to communicate with the compression chamber communicating with the back-pressure supply path, when a rotation direction of the drive shaft is a positive direction.

13. The scroll compressor of claim 1, wherein the fixed scroll includes a fixed-scroll wrap having an inner surface and an outer surface, the movable scroll includes a movable-scroll wrap having an inner surface and an outer surface, the compression chamber includes a first compression chamber formed between the inner surface of the fixed-scroll wrap of the fixed scroll and the outer surface of the movable-scroll wrap of the movable scroll, and a second compression chamber formed between the outer surface of the fixed-scroll wrap and the inner surface of the movable-scroll wrap, and the back-pressure supply path includes a first inlet communicating with the first compression chamber right before the first compression chamber communicates with the outlet port, and a second inlet communicating with the second compression chamber right before the second compression chamber communicates with the outlet port.

14. The scroll compressor of claim 13, further comprising:

a drive shaft including a main shaft section and an eccentric section engaged with the movable scroll so as to be eccentric to the main shaft section, the main shaft section having a main shaft center and the eccentric section having an eccentric shaft center, the back-pressure supply path being formed in the movable scroll, the valve member of the back-flow prevention mechanism moving in a predetermined first direction when the back-flow prevention mechanism is switched from astute in which fluid circulation in the back-pressure supply path is prevented to a state in which the fluid circulation in the back-pressure supply path is allowed, and an angle between the first direction and a second direction which is a direction of a line from the main shaft center of the main shaft section toward the eccentric shaft center of the eccentric section being equal to or greater than −90° and equal to or less than 90° as viewed in an axial direction of the drive shaft when the outlet port comes to communicate with the compression chamber communicating with the back-pressure supply path, when a rotation direction of the drive shaft is a positive direction.

15. The scroll compressor of claim 1, further comprising:

a drive shaft including a main shaft section and an eccentric section engaged with the movable scroll so as to be eccentric to the main shaft section, the main shaft section having a main shaft center and the eccentric section having an eccentric shaft center, the back-pressure supply path being formed in the movable scroll, the valve member of the back-flow prevention mechanism moving in a predetermined first direction when the back-flow prevention mechanism is switched from a state in which fluid circulation in the back-pressure supply path is prevented to a state in which the fluid circulation in the back-pressure supply path is allowed, and an angle between the first direction and a second direction which is a direction of a line from the main shaft center of the main shaft section toward the eccentric shaft center of the eccentric section being equal to or greater than −90° and equal to or less than 90° as viewed in an axial direction of the drive shaft when the outlet port comes to communicate with the compression chamber communicating with the back-pressure supply path, when a rotation direction of the drive shaft is a positive direction.

16. The scroll compressor of claim 15, wherein the angle between the first and second directions is equal to or greater than 0° and equal to or less than 90°, when the rotation direction of the drive shaft is the positive direction.

* * * * *